United States Patent [19]

Corley

[11] Patent Number: 4,791,907

[45] Date of Patent: Dec. 20, 1988

[54] FISHING ARROW REST FOR ARCHERY BOW

[76] Inventor: Wilbur E. Corley, 727 Holiday La., Claremore, Okla. 74017

[21] Appl. No.: 9,388

[22] Filed: Jan. 30, 1987

[51] Int. Cl.[4] ..... F41D 10/00; F41B 5/00

[52] U.S. Cl. ..... 124/41 A; 124/24 R

[58] Field of Search ..... 124/41 A, 41 B, 24 R, 124/88, 86

[56] References Cited

U.S. PATENT DOCUMENTS

| | | | |
|---|---|---|---|
| 3,285,237 | 11/1966 | Wolfe | 124/41 A |
| 3,998,811 | 9/1961 | Sackmann | 124/24 R |
| 4,324,221 | 4/1982 | Peck | 124/41 A |
| 4,378,780 | 4/1983 | Izuta | 124/41 A |

*Primary Examiner*—Richard C. Pinkham
*Assistant Examiner*—Mark S. Graham
*Attorney, Agent, or Firm*—Robert B. Stevenson

[57] ABSTRACT

A rotatable fishing arrow rest comprising a threaded support member (with or without lock nut) adapted to thread into an arrow rest hole provided in the arrow window of an archery bow wherein the support member pivotally retains a roller having a pair of rubber O-rings of two difference diameters (larger diameter O-ring mounted on the outer and the smaller O-ring mounted on the inner side of the roller relative to the archery bow) in the window area of the archery bow such that the arrow shaft makes rolling contact with each rubber O-ring as the arrow is launched. The rotatable arrow rest can further be equipped with a fabric cushion that attaches to the archery bow adjacent to the rubber O-rings such that the arrow shaft touches the fabric cushion as the arrow is launched. Such a rotatable arrow rest is particularly useful in absorbing the oscillations and lateral forces created in a fishing arrow shaft by the archery bow, while simultaneously reducing frictional losses.

4 Claims, 1 Drawing Sheet

FISHING ARROW REST FOR ARCHERY BOW

BACKGROUND OF THE INVENTION

1. Field of the Invention

The present invention relates to an arrow rest for archery. More specifically, the invention relates to the use of a rotating arrow rest for fishing arrows.

2. Description of the Prior Art

The concept of employing an arrow rest for archery bows wherein the arrow rest is connected to the sidewall of the bow generally in the window area of the bow is known and an accepted practice. Such arrow rests are employed to form a support for the arrow shaft, whereby the arrow shaft may be aimed accurately as it is shot from the bow. Frequently, the bow rest will involve a pair of articulated arms that make contact with the arrow shaft at two points of contact which are traditionally positioned such as to allow the trailing feathers of the arrow to pass by undisturbed, an unnecessary feature for fishing arrows since they usually have no feathers. In this manner, the force of the bow string used to propel the arrow results in certain downward and lateral forces on the arrow shaft which are in turn partially compensated for by the presence of the arrow rest. Traditionally, such arrow rests involve frictional contact only. However, recently at least one manufacturer has proposed the use of a spinner or wheel to reduce the friction. Such a device involves resting the arrow in a symmetric channel around the circumference of the spinner and launching the arrow as the wheel with arrow resting therein travels along the shaft of the arrow. However, such a device does not fully compensate for the oscillations and forces induced in the arrow as it is launched.

SUMMARY OF THE INVENTION

The present invention provides a rotatable arrow rest having the ability to simultaneously reduce the frictional losses associated with launching of an arrow, yet intentionally applying stabilizing drag on opposite sides of the arrow shaft. As such, the improved arrow rest according to the present invention has been found to accommodate the forces induced in a fishing arrow shaft by the archery bow.

Thus, the present invention provides a rotatable arrow rest comprising:

(a) a threaded support means adapted to threadably engage to a threaded arrow rest hole provided in the arrow window of an archery bow and further adapted to extend essentially perpendicularly into the window area of the archery bow, wherein the end of the threaded support means directed into the window area of the archery bow is further adapted to retain a roller; and (b) a roller means operatively attached to the threaded support means and held adjacent to the archery bow in the window area such as to revolve around an axis essentially perpendicular to the archery bow, wherein the roller means further comprises a pair of rubber O-rings of two different diameters mounted on the outer perimeter of the roller means wherein the larger diameter O-ring is mounted to the outside of the smaller diameter O-ring such that the arrow shaft makes rolling contact with each O-ring as the arrow is launched.

In one preferred embodiment of the present invention, the rotatable arrow rest further comprises a fabric cushion means adapted to operatively attach to the archery bow adjacent and facing the O-rings mounted on the roller means, such that the arrow shaft also touches the face of the fabric cushion as the arrow is launched. The threaded support means can further be equipped with at least one threaded lock nut that compressibly holds the threaded support means and roller means at a fixed position relative to the archery bow window.

It is an object of the present invention to provide a rotatable arrow rest. It is a further object to provide such a rotatable arrow rest that employs two rubber O-rings of different diameters that make contact with the arrow shaft during the launching of the arrow. It is still a further object of the present invention that the pair of rubber O-rings create a drag on one side of the shaft of the arrow, while a fabric contact pad creates drag on the other side of the arrow during launching. Fulfillment of these objects and the presence and fulfillment of additional objects will become apparent upon complete reading of the specification and claims taken in conjunction with the attached drawings.

DESCRIPTION OF THE PREFERRED EMBODIMENTS

Figure 1:
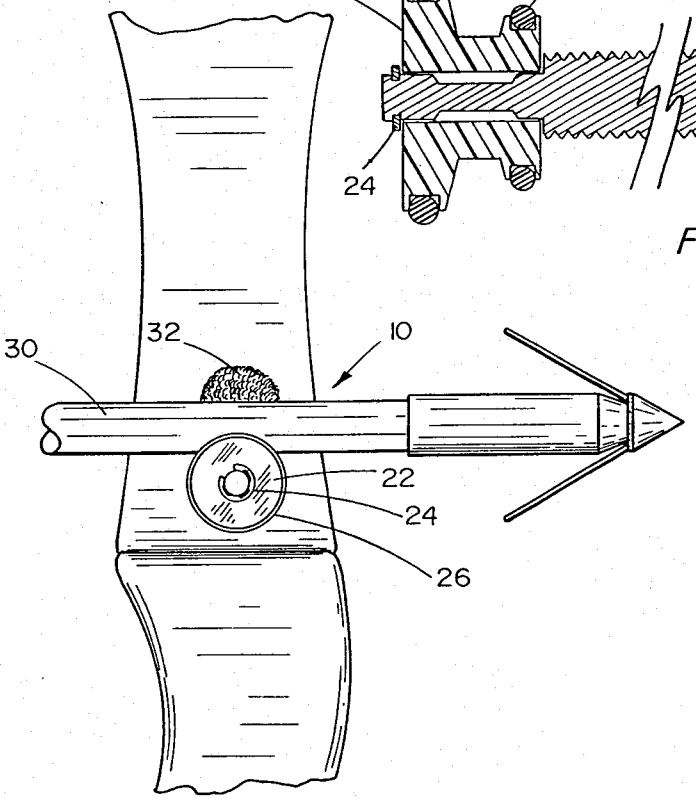
FIG. 1 is a side view of an archery bow with a fishing arrow positioned on the arrow rest according to the present invention.
Figure 2:
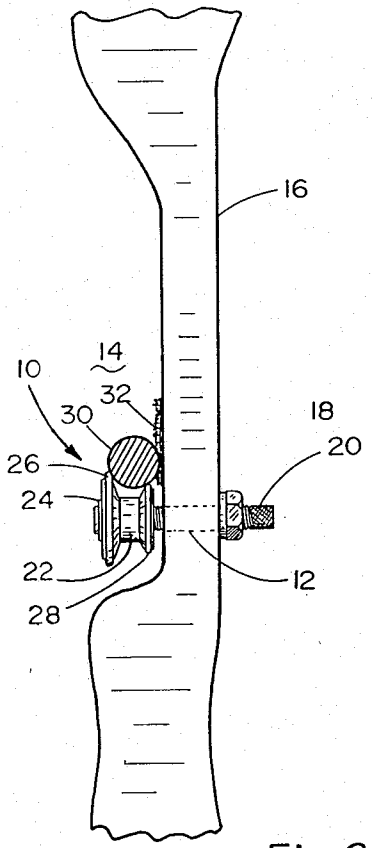
FIG. 2 is a frontal view of the archery bow with arrow and arrow rest as shown in FIG. 1 seen through line 2—2.

The rotatable arrow rest according to the present invention, how it functions and how it differs from the prior art devices, as well as the advantages associated with its use can perhaps be best explained and understood by reference to the drawings. As illustrated in FIGS. 1 and 2, the arrow rest according to the present invention (generally designated by the numeral 10) is intended to be mounted to the conventional threaded hole 12 as provided by the manufacturer usually found in the window area 14 of the archery bow 16. As seen in the figures, the rotatable arrow rest 10 involves a threaded support means 18 which threads directly through the hole 12 and as such, extends, essentially horizontally, into the window area 14. As illustrated in the enlarged cross-sectional view of FIG. 3, the support means 18 has a finger gripping surface 20 at one end and a revolving wheel or roller means 22 at the other, held in place, in this embodiment, by a snap ring 24. The revolvable wheel or roller means 22 is oriented such that it revolves around an axis essentially perpendicular to the archery bow. The roller means 22 is further equipped with a pair of rubber O-rings 26 and 28. The O-ring 26 is located on the outer perimeter of roller member 22 and is slightly larger in diameter than the other rubber O-ring 28 located on the inner perimeter of the roller means 22 nearest the archery bow 16.

Figure 3:
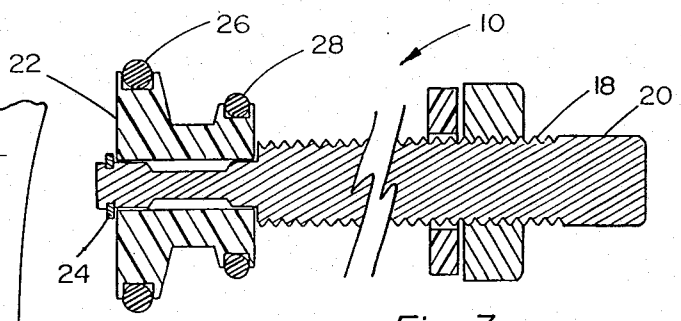
FIG. 3 is an enlarged cross-sectional side view of the rotatable arrow rest mechanism according to the present invention.

The spacing and size of the O-rings 26 and 28 are selected, according to the present invention, such that the shaft 30 of a fishing arrow will make, rolling contact with each rubber O-ring as the arrow is launched (see FIGS. 2 and 3). As further illustrated, the inner surface of the archery bow 16 adjacent to the smaller O-ring 28 and roller means 22 is equipped with a fabric pad 32 that is adhesively attached to the archery bow. This fabric pad 32 also makes frictional contact with the arrow shaft 30 as the arrow is launched.

In using the rotatable arrow rest according to the present invention, the arrow shaft makes contact with both the frictional pad (i.e., the inner side of the archery bow) and the O-rings of the revolving wheel of the arrow rest. It has been discovered that such a configuration results in improved ability to account for and compensate for the inherent downward and lateral forces associated with launching of a fishing arrow, yet accomplishes this with reduced frictional losses.

Although the present invention is viewed as involving an improved roller arrow rest system and as such the invention is not viewed as being limited to any specific scientific rationale or explanation as to why the device performs as observed, one possible explanation is that the present invention represents a device that reduces the overall frictional losses, yet simultaneously applies some friction drag along two different sides of the arrow shaft as it is launched. The use of the rotatable arrow rest inherently reduces the friction associated with the downward pull of gravity during launch of the arrow. Simultaneously the slight frictional loss associated with the touching of the arrow shaft on the archery bow (more specifically, the fabric pad) is balanced and compensated for by a slight frictional loss on the outer side of the arrow shaft caused by the contact of the shaft with two dissimilar (i.e., different diameters) O-rings each revolving at the same rate of revolution. As such, the revolving arrow rest of the present invention can be distinguished from the previously known devices by virtue of reducing overall frictional loss by use of a roller arrow rest while simultaneously applying minimum drag on opposite sides of the arrow shaft; i.e., contacting a fabric pad on one side and slippage between two dissimilar sized O-rings on the other side. It is this particular feature that is felt to distinguish the present invention from the previously known devices.

The revolving arrow rest according to the present invention can be made out of any of the materials generally known in the art and can be fabricated or assembled by any contemporary technique as generally practiced. As such, the device lends itself to contemporary machining, molding and/or similar fabrication procedures. Preferably, the O-rings are to be made out of an elastomeric or rubber material, again as generally known in the art.

Having thus described the invention with a certain degree of particularity, it is to be understood that the invention is not to be limited to the embodiments set forth herein for purposes of exemplification, but is to be limited only by the scope of the attached claims, including a full range of equivalents to which each element thereof is entitled.

I claim:

1. A rotatable arrow rest comprising:

(a) a threaded support means adapted to threadably engage to a threaded arrow rest hole provided in the arrow window of an archery bow and further adapted to extend essentially perpendicularly into the window area of the archery bow, wherein the end of said threaded support means directed into the window area of the archery bow is further adapted to retain a roller; and (b) a roller means operatively attached to said threaded support means and held adjacent to the archery bow in the window area such as to revolve around an axis essentially perpendicular to the archery bow substantially without lateral displacement, wherein said roller means further comprises a pair of rubber O-rings of two different diameters mounted on the outer perimeter of said roller means wherein the larger diameter O-ring is mounted to the outside of the smaller diameter O-ring such that the arrow shaft makes rolling contact with each O-ring as the arrow is launched.

2. A rotatable arrow rest of claim 1 further comprising a fabric cushion means adapted to operatively attach to the archery bow adjacent and facing said O-rings mounted on said roller means such that the arrow shaft also touches the face of said fabric cushion as the arrow is launched.

3. A rotatable arrow rest of claim 1 wherein said threaded support means is further equipped with at least one threaded lock nut that is adapted to compressibly hold said threaded support means and said roller means at a fixed position relative to the archery bow window.

4. A rotatable arrow rest of claim 2 wherein said threaded support means is further equipped with at least one threaded lock nut that is adapted to compressibly hold said threaded support means and said roller means at a fixed position relative to the archery bow window.

* * * * *